US005598139A

United States Patent [19]

Karim et al.

[11] Patent Number: 5,598,139

[45] Date of Patent: Jan. 28, 1997

[54] FIRE DETECTING SYSTEM WITH SYNCHRONIZED STROBE LIGHTS

[75] Inventors: Zia Karim, Warrenville; Ed Thorp, Aurora, both of Ill.

[73] Assignee: Pittway Corporation, Chicago, Ill.

[21] Appl. No.: 406,658

[22] Filed: Mar. 20, 1995

Related U.S. Application Data

[63] Continuation of Ser. No. 129,744, Sep. 30, 1993, abandoned.

[51] Int. Cl.[6] ..... G08B 25/00

[52] U.S. Cl. ..... 340/286.11; 340/691

[58] Field of Search ..... 340/908.1, 908, 340/332, 331, 286.11, 525, 691

[56] References Cited

U.S. PATENT DOCUMENTS

| | | | |
|---|---|---|---|
| 4,203,091 | 5/1980 | Kruskopf | 340/908.1 |
| 4,325,007 | 4/1982 | Prohaska et al. | 340/471 |
| 4,531,114 | 7/1985 | Topol et al. | 340/332 |
| 5,019,805 | 5/1991 | Curl et al. | 340/331 |

*Primary Examiner*—Michael Horabik
*Assistant Examiner*—Michael Day
*Attorney, Agent, or Firm*—Dressler, Goldsmith, Milnamow & Katz, Ltd.

[57] ABSTRACT

An alarm system for producing substantially synchronized visual output indicia of the alarm condition includes a common source of pulses which is activated in response to the presence of the alarm condition. The common source of pulses generates a trigger pulse train having a predetermined period. The trigger pulse train is fed, via power supply lines, to a plurality of visual output devices which can be triggered in response to the arrival of each of the pulses in the train thereby producing a synchronized plurality of visual indicia indicative of the alarm condition. The output devices will produce an essentially synchronized plurality of visual indicia in the presence of the alarm condition even in the absence of the trigger pulse train.

5 Claims, 3 Drawing Sheets

FIRE DETECTING SYSTEM WITH SYNCHRONIZED STROBE LIGHTS

This is a continuation of application Ser. No. 08/129,744, filed Sep. 30, 1993, now abandoned.

FIELD OF THE INVENTION

The invention pertains to synchronized, multi-indicator alarm systems. More particularly, the invention pertains to fire alarm systems which include a plurality of visual alarm indicators which preferably are energized in a synchronized fashion

BACKGROUND OF THE INVENTION

Alarm systems which incorporate a plurality of spaced apart sensors or detectors in combination with a central control panel are known. Such systems usually also incorporate a plurality of alarm indicators which are also coupled to the control panel. The alarm indicators are usually spaced apart, in the same general area as are the sensors.

The alarm indicators can be audible alarms such as horns, gongs or sirens. Alternately, the indicators can be visual alarms which are readily discernible by persons with essentially normal hearing as well as hearing impaired persons.

The visual indicators are often energized on an intermittent basis. A flashing visible light is radiated so that the alarm condition will be immediately noticed in the area adjacent to the flashing indicator. There continues to be a need for improved visual indicating systems which readily communicate to individuals in the area of the respective indicator that an alarm condition has been detected.

SUMMARY OF THE INVENTION

In accordance with the invention, a system is provided for producing synchronized indicia which are indicative of a predetermined event, such as a fire. The system includes two or more devices that can be used to indicate that the event has been detected.

Preferably, the indicators will include triggerable circuits which produce a characteristic indicium, which could be a pulse of visible light, in response to a trigger signal. The indicators are coupled to a conducting element which is in turn couplable to a power supply.

A synchronizing circuit is provided which is coupled to the conductor and hence to the indicators. The synchronizing circuit generates pulses, which could be periodic, in response to the occurrence of the predetermined event. The pulses are communicated via the conducting element to the triggerable indicators. Arrival of the pulses causes the indicators to produce synchronized outputs, which could be synchronized pulses of visible light.

In another aspect of the invention, an alarm system is provided. The alarm system includes a plurality of ambient condition sensors which can be coupled via a communication link to a control unit. In response to signals received from the sensors, the control unit determines whether or not an alarm condition exists in one or more regions adjacent to one or more respective sensors.

A plurality of indicators is coupled via a power conductor to the control unit. The power conductor is energized when an alarm condition has been detected. A trigger circuit is coupled to the control unit and to the conductor.

The trigger circuit generates a sequence of trigger pulses in response to the detected alarm condition. The trigger pulses cause members of the plurality of indicators to emit indicia of the alarm condition at essentially the same time.

In yet another aspect of the invention, the trigger circuit includes circuitry for producing a plurality of periodic trigger pulses wherein each pulse has a duty cycle of less than 50%. In yet another aspect of the invention, the indicators generate an output for only a limited period of time in response to a received trigger pulse.

In a further aspect of the invention each of the indicators can include a free running oscillator. The respective indicator, once energized can free run in the absence of trigger pulses.

These and other aspects and attributes of the present invention will be discussed with reference to the following drawings and accompanying specification.

DETAILED DESCRIPTION OF THE PREFERRED EMBODIMENT

Figure 1:
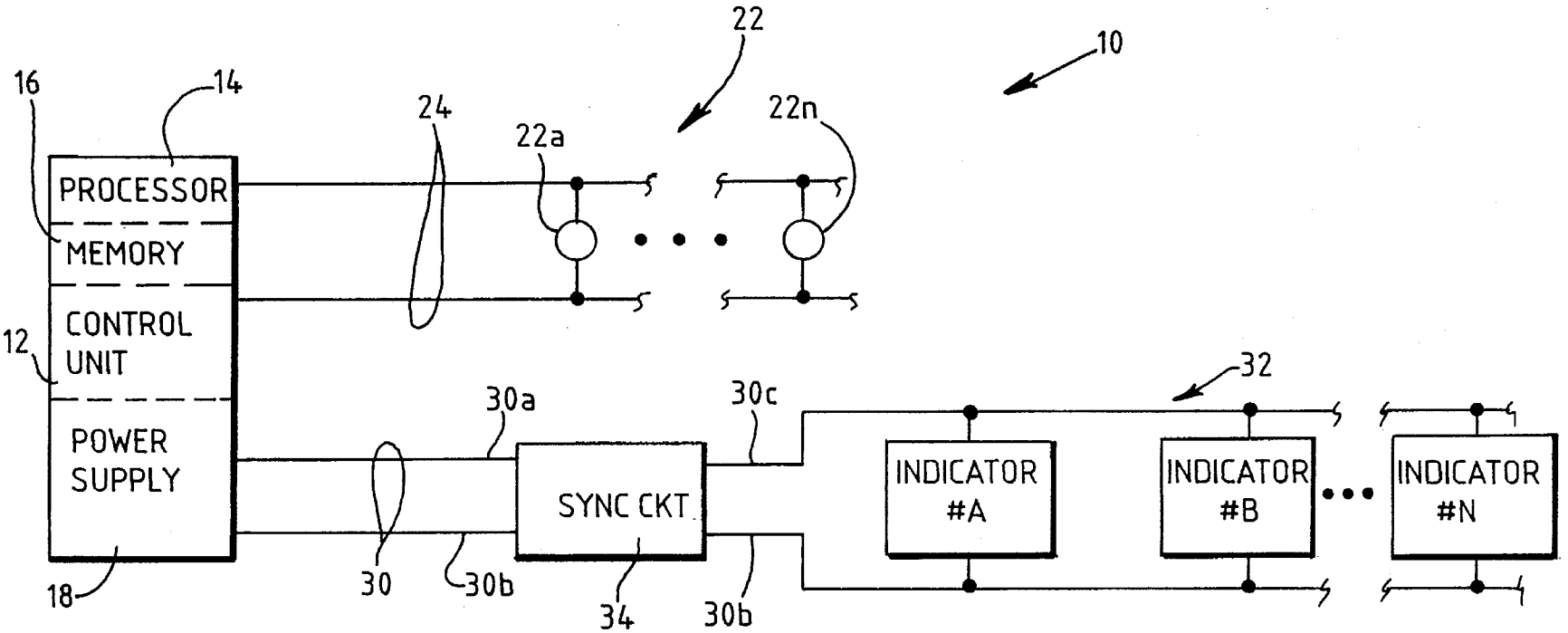
FIG. 1 is a block diagram of a system in accordance with the present invention.

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 is a block diagram of a system 10 in accordance with the present invention. The system 10 includes a control unit 12 which might include a programmable processor 14. The processor 14 includes a memory unit 16. The control unit 12 also includes a power supply 18. The supply 18 is intended to energize a plurality of output alarm devices.

The system 10 also includes a plurality of sensors or detectors 22 which are coupled via a bi-directional communications link 24 to the control unit 12.

The detectors **22*a*–22*n* provide signals to the control unit 12 indicative of a predetermined ambient condition. The control unit 12 can in turn determine whether or not a predetermined alarm condition exists in the vicinity of a respective one of the detectors 22*a* through 22*n***.

Coupled to the control unit 12, via power conductors 30, is a plurality of indicators 32. The power conductors 30 provide electrical energy from the supply 18 to the indicators 32. The supply 18 is enabled and provides energy to the conductors 30 (**30*c*, 30*b***) when an alarm condition has been detected.

The plurality 32 can include one or more audible alarm condition indicators such as a horn, a siren or a bell. In addition, the plurality 32 can include one or more visual alarm condition indicators.

The visual indicators could, for example, be implemented as high intensity triggerable strobe lights. Such lights often incorporate a sealed tubular member which includes an excitable gas which when ionized, produces a pulse of visible radiant energy.

Coupled to the conductors 30 is a synchronizing circuit 34. The synchronizing circuit can be located within the control unit 12, coupled to the power conductors 30, or incorporated in a selected one of the indicator units. The details of the location and coupling of the synchronizing circuit 34 are not a limitation of the present invention.

In response to the control unit having determined the existence of a predetermined alarm condition, noted above, the synchronizing circuit 34 responds to electrical energy from the supply 18 and generates a plurality of spaced apart trigger pulses having a period on the order of 2.7 seconds or thereabouts. The trigger pulses (output pulses) have a duty cycle substantially less than 50%.

Pulses from the synchronizing circuit 34 are coupled to power conductors 30*b*, 30*c* and are transmitted to the indicators 32 thereby. The trigger pulses on the power conductors 30*b*, 30*c* trigger the visible indicators causing each of those units to generate a predetermined quantum of radiant energy at essentially the same time. In response to the 2.7 second period of the trigger pulses, the visual indicators generate visible quanta or pulses of radiant energy with the same period.

Figure 2:
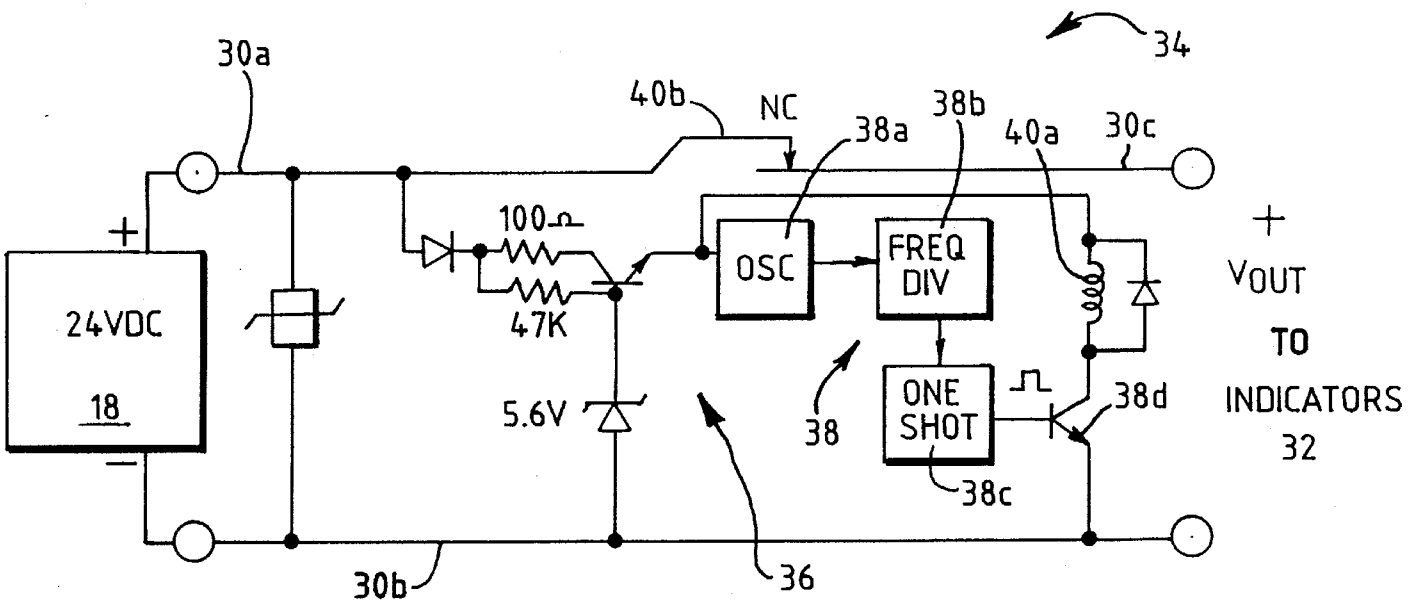
FIG. 2 is an overall schematic diagram of a synchronizing circuit in accordance with the present invention.

FIG. 2 is a schematic of an exemplary synchronizing circuit 34 in accordance with the present invention. Output from the circuit 34, as discussed above, is coupled to the indicators 32.

The synchronizing circuit 34 includes a regulator circuit indicated generally at 36 which in turn is coupled to a pulse generating circuit indicated generally at 38. The pulse generating circuit includes a free running oscillator 38*a*, a frequency divider 38*b* and a one-shot 38*c*.

The output from the frequency divider 38*c* has a period on the order of 2.9 seconds. The one-shot produces an output pulse with a width on the order of 20 to 30 milliseconds.

The output from the one-shot 38*c* via a driver transistor 38*d* is coupled to a coil 40*a* of a relay. When the one-shot 38*c* is triggered generating the 20 to 30 millisecond wide pulse, the transistor conducts and the coil 40*a* is energized thereby opening a normally closed relay contact 40*b*.

Figure 3:
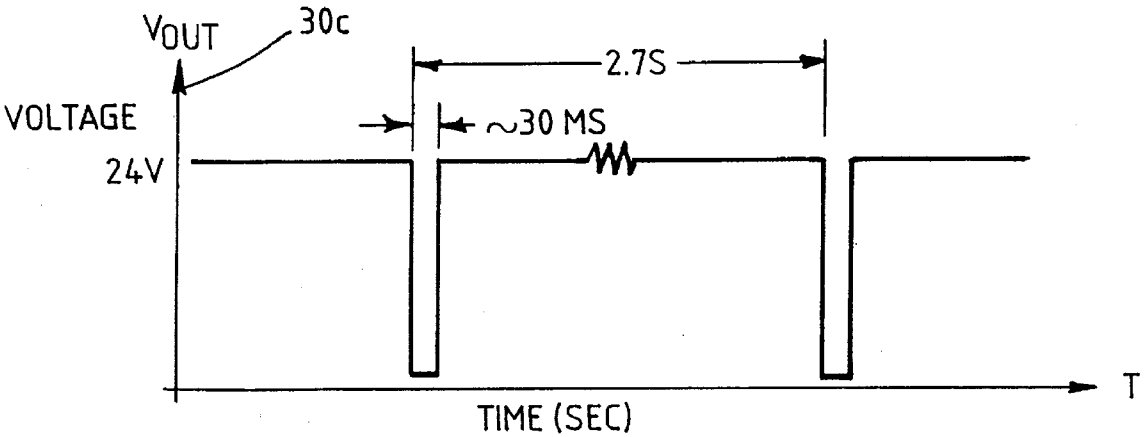
FIG. 3 is a graph of voltage vs. time illustrating an output voltage wave form of the circuit of FIG. 2.

The process of opening the normally closed contact 40*b* for an interval on the order of 20 to 30 milliseconds causes the voltage across the lines 30*b*, 30*c* to drop essentially to zero volts, thereby producing a negative going pulse as illustrated in the graph of FIG. 3.

FIG. 3 illustrates graphically an output pulse train $V_{out}$ generated by the synchronizing circuit 34 on the lines 30. The output pulse train $V_{out}$ has a period on the order of 2.9 seconds. Each pulse has a width on the order of 20–30 milliseconds.

Figure 4:
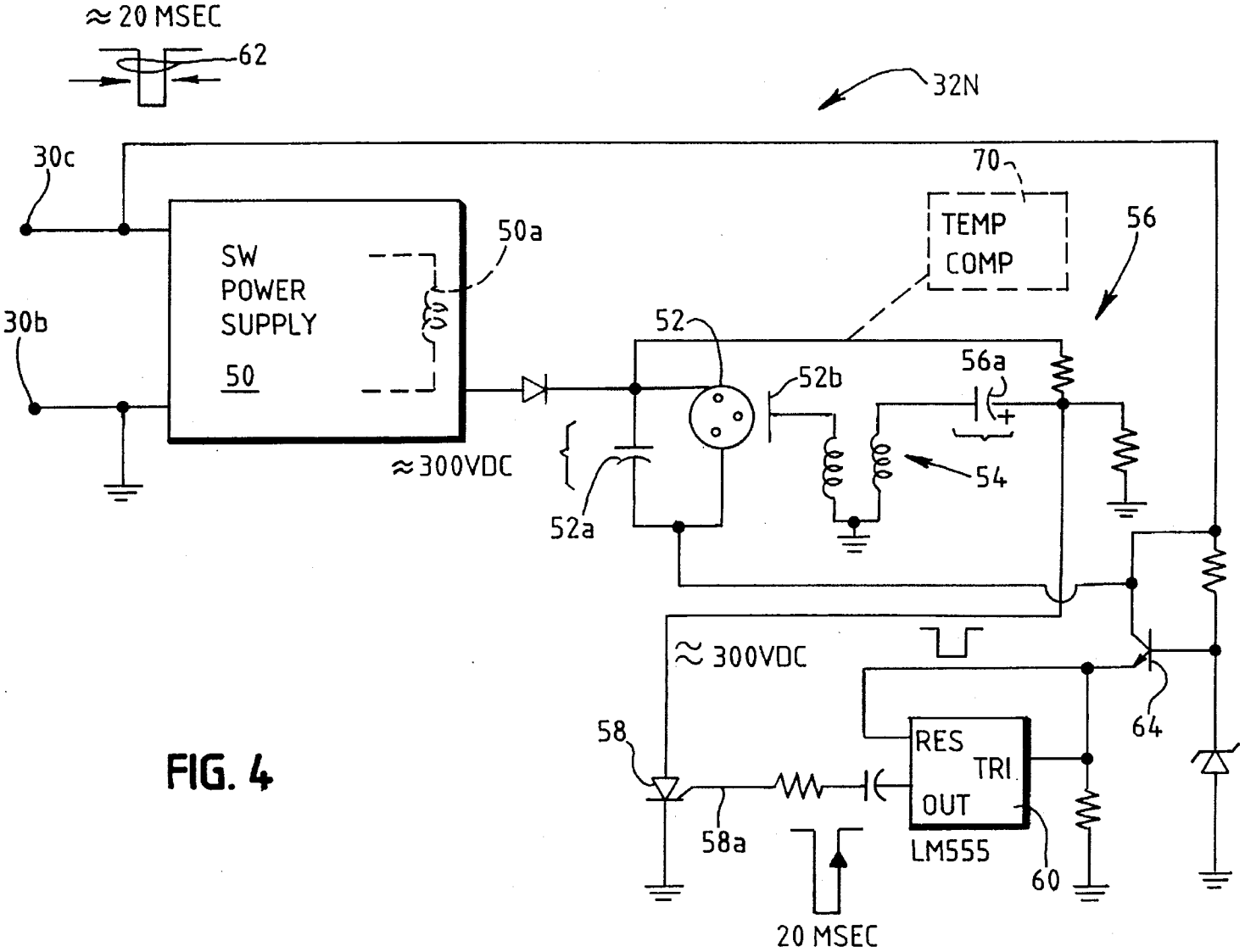
FIG. 4 is a schematic of strobe unit usable in the system of FIG. 1.

FIG. 4 is a schematic of a synchronizable visual indicator unit 32N from the plurality 32. Energy is applied to the synchronizable indicator unit 32N via the power conductors 30*b*, 30*c* which also carry the trigger signals from the synchronizing circuit 34.

The synchronizable indicator unit 32N includes a switching power supply 50. The switching power supply 50 is energized with electrical energy from the power supply 18, as processed by the synchronizing circuit 34, via the conductors 30*b* and 30*c*. The switching power supply 50 includes an inductor 50*a* as an output element.

Coupled to the switching power supply 50 and output the inductor 50*a* is a bulb 52 filled with an ionizable gas for generating a high intensity light pulse. Coupled across the bulb 52 is an energy storage capacitor 52*a*.

The bulb 52 also includes a trigger electrode 52*b* which is coupled to a triggering transformer 54. The transformer 54 is coupled to a trigger circuit 56 which includes a triggering capacitor 56*a*.

The triggering capacitor 56*a* is coupled to a silicon controlled rectifier 58. A gate input 58*a* of the silicon controlled rectifier 58 is coupled to an output of an LM555 timer 60.

In response to electrical energy from the power supply 18 being received on the conductors 30*b* and 30*c*, the switching power supply 50, via the inductor 50*a*, charges up the capacitor 52*a* to about 300 volts DC. This voltage is not only coupled across the strobe element 52, but also across the trigger capacitor 56*a* thereby charging same to about 300 volts DC as well. Similarly, the anode of the silicon controlled rectifier 58 also has about 300 volts DC applied thereto.

When a strobe pulse, such as the pulse 62 is received on the lines 30*b*, 30*c* that pulse is coupled via a transistor 64 to a reset input of the timer 60. The timer 60 in turn follows the reset input and generates a pulse width on the order of 20 to 30 milliseconds on a output line. This pulse is in turn coupled to the gate input 58*a* of the silicon controlled rectifier 58 triggering same on an upgoing edge thereof.

When the silicon controlled rectifier 58 initiates conduction, a negative voltage on the order of 300 volts is applied across a primary of the trigger transformer 54. This voltage in turn generates a trigger voltage at the electrode 52*b* causing the gases in the strobe element 52 to ionize. The electrical energy stored on the capacitor 52*a* is then dumped through the strobe element 52 producing an intense but very short output quantum of radiant energy which can be used as a visual indication of an alarm condition.

The LM555 timer 60 is configured such that the power-up time is on the order of 3 seconds after a reset signal has been received. Hence, the LM555 will not on its own initiate a pulse for about three seconds after having received a reset pulse via the transistor 64. Each time the reset pulse arrives, the LM555 timer 60 initiates an output pulse to the gate 58*a* and then restarts its power-up sequence with the approximate three second delay before the next pulse is generated. After the 3 second power up interval, the timer 60 will free run with a period of about 2.7 seconds.

So long as timing pulses 62 continue to appear on the lines 30*b*, 30*c* the LM555 timer will periodically be reset and as a result, generate output pulses at the same frequency and substantially the same width as the 20 to 30 millisecond pulses, with a period on the order of 2.9 seconds which appear on the lines 30*b* and 30*c*. As a result, the strobe unit 52 will be pulsed at the same frequency as the synchronizing pulses on the power conductors 30*b* and 30*c*. Hence, the plurality of indicator units 32A through 32N can be triggered on a synchronized basis by the pulses 62 on the power lines.

In the event that the power supply 18 is providing electrical energy to the conductors 30 and for some reason the synchronizing circuitry 34 is not functioning to periodically open the normally closed contacts 40*b*, the LM555 timer 60 of the unit 32N will free-run with a period on the order of 2.7 seconds and will thus trigger the strobe element 52 at that periodic rate. In this instance, the oscillators in each of the indicator units such as the unit 32A and the unit 32N oscillate independently of one another and the visual outputs from the respective indicators are not synchronized together.

Thus, the indicator units in the plurality 32, such as 32A and 32N, when triggered by a pulse from the synchronizing circuit 34 provide a plurality of synchronized visual outputs indicating the existence of the alarm condition. In the presence of the alarm condition, but in the absence of pulses from the synchronizing circuitry 34, the visual indicators 32A and 32N function substantially synchronously due to the presence of the LM555 timer 60 in each respective indicator unit. The timer circuits 60, while functioning independently, generate substantially similar output pulse trains at substantially the same time to produce a substantially synchronized visual output from the respective strobe elements notwithstanding the absence of a common pulse from the synchronizing circuitry 34.

It will also be understood that the above described synchronizable indicator units, such as the 32N could include temperature compensating circuitry 70, indicated in phantom in FIG. 4, for the purpose of maintaining a substantially constant level of radiant energy output as a function of varying temperature of the unit.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A fire detecting system with synchronized visual outputs indicative of a detected fire condition, the system comprising:

a plurality of spaced apart sensors wherein each of said sensors provides a signal indicative of a sense ambient condition;

a control unit with at least one communications link for providing bidirectional communication between said sensors and said unit, wherein said control unit includes circuitry for detecting an alarm condition in response to signals received from said sensors via said link, and wherein said unit includes a power supply which is enabled when said condition is detected;

a power conductor, separate from said link, coupled to said power supply;

a synchronizing circuit, coupled to said power conductor wherein said circuit produces a plurality of common, spaced apart synchronizing electrical pulses on at least a portion of said conductor, in response to said power supply being enabled; and a plurality of flashable visual output devices, coupled in parallel to one another on said portion of said conductor, for receiving energy from said supply, if enabled and for receiving said common synchronizing pulses and wherein said output devices flash at essentially the same time, at a first rate, in response to said common synchronizing pulses and wherein said output devices flash in response to energy from said supply, in the absence of said synchronizing pulses.

2. A system as in claim 1 wherein said output devices each include an oscillator and wherein said oscillator is reset by said synchronization pulses.

3. A system as in claim 1 wherein said output devices each include an oscillator, wherein said oscillator is reset by said synchronization pulses and wherein in the presence of said electrical energy but in the absence of said synchronizing pulses each said oscillator, in a respective output device, will cause said device to flash on a repetitive basis.

4. A system as in claim 1 wherein said synchronizing circuit includes a normally closed relay coupled to oscillator circuitry wherein said common synchronizing pulses are generated in response to said oscillator circuitry opening said relay for a predetermined period of time at a predetermined frequency.

5. A system as in claim 1 wherein each of said output devices includes a timer circuit with a reset input wherein said synchronizing pulses are coupled to each of said respective reset inputs thereby flashing said respective output device at said first rate.

* * * * *